US005078977A

United States Patent [19]

Mudder et al.

[11] Patent Number: 5,078,977

[45] Date of Patent: * Jan. 7, 1992

[54] CYANIDE RECOVERY PROCESS

[75] Inventors: Terry I. Mudder, Duvall, Wash.; Adrian J. Goldstone, Waihi Beach, New Zealand

[73] Assignee: Cyprus Minerals Company, Englewood, Colo.

[ * ] Notice: The portion of the term of this patent subsequent to Feb. 19, 2008 has been disclaimed.

[21] Appl. No.: 424,765

[22] Filed: Oct. 20, 1989

Related U.S. Application Data

[63] Continuation-in-part of Ser. No. 261,386, Oct. 21, 1988, Pat. No. 4,994,243.

[51] Int. Cl.[5] ..... C22B 11/08; C01C 3/08; C01C 3/10; C01G 7/00

[52] U.S. Cl. ..... 423/1; 423/29; 423/30; 423/31; 423/379; 75/737

[58] Field of Search ..... 75/105, 737; 423/29, 423/30, 31, 379, 1

[56] References Cited

U.S. PATENT DOCUMENTS

| | | | |
|---|---|---|---|
| 494,054 | 3/1893 | Birkin | 75/105 |
| 496,950 | 5/1893 | Parkes et al. | 75/105 |
| 705,698 | 7/1902 | Officer et al. | 423/30 |
| 823,576 | 6/1906 | Arnold | 423/30 |
| 1,387,289 | 8/1921 | Mills et al. . | |
| 3,403,020 | 9/1968 | Lower | 75/106 |
| 3,592,586 | 7/1971 | Scott | 23/79 |
| 3,617,567 | 11/1971 | Mathre | 210/50 |
| 4,250,030 | 2/1981 | Kuit et al. | 210/684 |
| 4,267,159 | 5/1981 | Crits | 423/371 |
| 4,289,532 | 9/1981 | Matson et al. | 75/105 |
| 4,312,760 | 1/1982 | Neville | 210/724 |
| 4,537,686 | 8/1985 | Borbely et al. | 210/713 |
| 4,578,163 | 3/1986 | Kunter et al. | 204/110 |
| 4,612,021 | 9/1986 | Bland et al. | 55/53 |
| 4,654,079 | 3/1987 | Nunez et al. | 423/30 |
| 4,708,804 | 11/1987 | Coltrinari | 210/677 |
| 4,752,400 | 6/1988 | Pearson | 210/718 |

FOREIGN PATENT DOCUMENTS

| | | |
|---|---|---|
| 8808408 | 11/1988 | PCT Int'l Appl. . |
| 8901357 | 2/1989 | PCT Int'l Appl. . |

OTHER PUBLICATIONS

"Precious Metals", Section 18 by McQuiston, Jr. and Shoemaker.

"*Principles of Industrial Waste Treatment*", by Gurnham, section entitled Ion Exchange Applications, pp. 242–245.

"New Hydrometallurgical Process for Au Recovery From Cyanide Solution", *Mining Magazine*, Jan. 1988, pp. 60–61.

"The Application of Cyanide Regeneration to the Treatment of Refractory, Complex or Copper Bearing Ores as Practiced by Companie de Real Del Montey Pauchuca", by Frank A. Seeton.

"Stripping of HCN is a Packed Tower", by Avedesian, Spira and Canduth. *The Canadian Journal of Chemical Engineering*, vol. 61, Dec. 1983, pp. 801–806.

"Vapor-Liquid Equilibria in Multicomponent Aqueous Solutions of Volatile Weka Electrolytes", by Edwards, Maurer, Newman and Prausntiz, AICHE Journal, vol. 24, No. 6, Nov. 1978, pp. 966–976.

(List continued on next page.)

*Primary Examiner*—Wayne A. Langel
*Attorney, Agent, or Firm*—Sheridan, Ross & McIntosh

[57] ABSTRACT

A process for removing and recovering cyanide from a cyanide-containing mixture. The process includes the steps of adjusting the pH of the cyanide-containing mixture to between about 6 to about 9.5, volatilizing the HCN contained in the pH adjusted mixture and contacting the volatilized HCN with basic material. Preferably, the cyanide recovery process is performed on tailings slurries resulting from metal recovery processes.

37 Claims, 4 Drawing Sheets

OTHER PUBLICATIONS

"Cyanide and the Environment" (A Collection of Papers from the Proceedings of a Conference held in Tucson, Ariz., Dec. 11-14, 1984) edited by Dirk Van Zyl.

"Cyanidation and Concentration of Gold and Silver Ores", by Dorr and Bosqui, 2nd edition, published by McGraw-Hill Book Company, 1950.

"Canmet AVR Process for Cyanide Recovery and Environmental Pollution Control Applied to Gold Cyanidation Barren Bleed from Campbell Red Lakes Mines, Limited, Balmerton, Ontario", by Vern M. McNamara, Mar. 1985.

"Removal of Cyanide from Gold Mill Effluents", by Ingles and Scott, presented at the Canadian Mineral Processors 13th Annual Meeting, Ottawa, Ontario, Canada, Jan. 20-22, 1981.

"Overview of Cyanide Treatment Methods", by Ingles and Scott, presented at the Canadian Mineral Processors 13th Annual Meeting, Ottawa, Ontario, Canada, Jan. 20-22, 1981.

"Golconda Claims World First for Cyanide Regeneration Process", by Doug Wilson, Gold Gazette, Dec. 7, 1987, p. 35.

"New Process Regenerates Cyanide from Gold and Silver Leach Liquors", The Engineering and Mining Journal, Jun. 1988, p. 55.

"Cyanide Regeneration", *Mining*, Jul. 1988, pp. 60-61.

"Cyanide Regeneration from Gold Tailings-Golconda's Beaconsfield Experience", by Michael J. Kitney, *Perth Gold 88*, pp. 89-93.

CYANIDE RECOVERY PROCESS

This is a continuation-in-part application of U.S. Ser. No. 261,386 filed Oct. 21, 1988, U.S. Pat. No. 4,994,243.

FIELD OF THE INVENTION

The present invention relates cyanide removal and recovery from cyanide-containing mixtures.

BACKGROUND OF THE INVENTION

Cyanides are useful materials industrially and have been employed in fields such as electro-plating and electro-winning of metals, gold and silver recovery from ores, treatment of sulfide ore slurries in flotation, tannery processes, etc. Due to environmental concerns, it is desirable to remove or destroy the cyanide present in the waste solutions resulting from such processes. Additionally, in view of the cost of cyanide, it is desirable to regenerate the cyanide for reuse.

Techniques for cyanide disposal or regeneration (recovery) in waste solutions include: ion exchange, oxidation by chemical or electrochemical means, and acidification-volatilization-reneutralization (AVR). The term cyanide recovery and regeneration are used interchangeably herein.

U.S. Pat. No. 4,267,159 by Crits issued May 12, 1981, discloses a process for regenerating cyanide in spent aqueous liquor by passing the liquor through a bed of suitable ion exchange resin to segregate the cyanide.

U.S. Pat. No. 4,708,804 by Coltrinari issued Nov. 24, 1987, discloses a process for recovering cyanide from waste streams which includes passing the waste stream through a weak base anion exchange resin in order to concentrate the cyanide. The concentrated cyanide stream is then subjected to an acidification/ volatilization process in order to recover the cyanide from the concentrated waste stream.

U.S. Pat. No. 4,312,760 by Neville issued Jan. 26, 1982, discloses a method for removing cyanides from waste water by the addition of ferrous bisulfite which forms insoluble Prussian blue and other reaction products.

U.S. Pat. No. 4,537,686 by Borbely et al. issued Aug. 27, 1985, discloses a process for removing cyanide from aqueous streams which includes the step of oxidizing the cyanide. The aqueous stream is treated with sulfur dioxide or an alkali or alkaline earth metal sulfite or bisulfite in the presence of excess oxygen and a metal catalyst, preferably copper. This process is preferably carried out at a pH in the range of 5 to 12.

U.S. Pat. No. 3,617,567 by Mathre issued Nov. 2, 1971, discloses a method for destroying cyanide anions in aqueous solutions using hydrogen peroxide ($H_2O_2$) and a soluble metal compound catalyst, such as soluble copper, to increase the reaction rate. The pH of the cyanide solution to be treated is adjusted with acid or base to between 8.3 and 11.

Treatments based on oxidation techniques have a number of disadvantages. A primary disadvantage is that no cyanide is regenerated for reuse. Additionally, reagent costs are high, and some reagents (e.g. $H_2O_2$) react with tailing solids. Also, in both the Borbely et al and Mathre processes discussed above, a catalyst, such as copper, must be added.

U.S. Pat. No. 3,592,586 by Scott issued July 13, 1971, describes an AVR process for converting cyanide wastes into sodium cyanide in which the wastes are heated and the pH is adjusted to between about 2 and about 4 in order to produce hydrogen cyanide (HCN). The HCN is then reacted with sodium hydroxide in order to form sodium cyanide. Although the process disclosed in the Scott patent is described with reference to waste produced in the electro-plating industry, AVR processes have also been applied to spent cyanide leachate resulting from the processing of ores. Such spent cyanide leachate typically has a pH greater than about 10.5 prior to its acidification to form HCN.

AVR processes employed in the mineral processing field are described in the two volume set "Cyanide and the Environment" (a collection of papers from the proceedings of a conference held in Tucson, Ariz., Dec. 11–14, 1984) edited by Dirk Van Zyl, "Cyanidation and Concentration of Gold and Silver Ores," by Dorr and Bosqui, Second Edition, published by McGraw-Hill Book Company 1950, and "Cyanide in the Gold Mining Industry: A Technical Seminar," sponsored by Environment Canada and Canadian Mineral Processor, Jan. 20–22, 1981. Another description of an AVR process can be found in "Canmet AVR Process for Cyanide Recovery and Environmental Pollution Control Applied to Gold Cyanidation Barren Bleed from Campbell Red Lakes Mines Limited, Balmerton, Ontario," by Vern M. McNamara, March 1985. In the Canmet process, the barren bleed was acidified with $H_2SO_4$ to a pH level typically between 2.4 and 2.5. $SO_2$ and $H_2SO_3$ were also suitable for use in the acidification.

AVR processes take advantage of the very volatile nature of hydrogen cyanide at low pH. In an AVR process, the waste stream is first acidified to a low pH (e.g. 2 to 4) to dissociate cyanide from metal complexes and to convert it to HCN. The HCN is volatilized, usually by air sparging. The HCN evolved is then recovered, for example, in a lime solution, and the treated waste stream is then reneutralized. A commercialized AVR method known as the Mills-Crowe method is described in Scott and Ingles, "Removal of Cyanide from Gold Mill Effluents," Paper No. 21 of the Canadian Mineral Processors 13 Annual Meeting, in Ottawa, Ontario, Canada, Jan. 20–22, 1981.

A process using AVR to recover cyanide values from a liquid is described in Patent Cooperation Treaty application PCT/AU88/00119, International Publication No. WO88/08408, of Golconda Engineering and Mining Services PTY. LTD. The disclosed process involves treating a tailings liquor from a minerals extraction plant by adjusting the pH into the acid range to cause the formation of free hydrogen cyanide gas. The liquid is then passed through an array of aeration columns arranged in stages so that the liquid flowing from one aeration column in a first stage is divided into two or more streams which are introduced into separate aeration columns in successive stages. In a recent paper describing the process, it was stated that plant shutdown would occur if pH went above 3.5. In a commonly assigned application, PCT/AU88/00303, International Publication No. WO89/081357, a process for clarifying liquors containing suspended solids is disclosed. The feed slurry is acidified to a pH of 3 or lower. Flocculants are added to cause the formation flocs to enable the separation of the suspended solids from the liquor. The clarified liquor can then be used as a feedstock for the AVR process disclosed in the other commonly assigned application.

The AVR processes described in the Scott patent and the above-mentioned texts typically include the step of adjusting the pH of the spent cyanide stream to within the range from about 2 to about 4. There are several problems with such processes. These AVR processes are expensive due to the amount of acidifying agent required to lower the pH to within this range. Also, such processes require a substantial amount of base to reneutralize the waste stream after the volatilization of HCN and prior to disposal. Further, insoluble metal complexes form at the acid conditions employed in these processes. The above-mentioned references only disclose a treatment of barren bleed which typically results from Merrill-Crowe type cyanidation treatment of ore. This bleed does not contain solid tailings. Today many ores are treated by a carbon-in-leach or carbon-in-pulp cyanidation process. The tailings from such processes include the solid barren ore in the spent leachate. Typically the tailing slurries contain about 30% to 40% by weight solids and about 100 to 350 parts per million (ppm) cyanide. In the past, such tailings were typically impounded and the cyanide contained therein was allowed to degrade naturally. Due to environmental concerns about cyanide, such impoundment is not a desirable alternative in many situations. Therefore, it is often necessary to treat the material in some manner to decompose the cyanide. This is expensive due to the costs associated with the treatment, as well as the loss of cyanide values which results.

Therefore, it would be advantageous to remove cyanide from a cyanide-containing waste stream in an economical manner. Further, it would be advantageous to provide a process for treating cyanide-containing slurries which also contain ore tailings. It would be advantageous if the amount of cyanide present in the waste stream could be reduced. It would also be advantageous to regenerate the cyanide for reuse.

It has now been found that when the HCN is volatilized at pH ranges higher than those previously employed, significant advantages are achieved. For example, cost savings can be realized due to the reduced amounts of reagents required to acidify and subsequently raise the pH of the waste stream. Additionally, many insoluble complexes which form under strong acid conditions will not form in the pH range employed in the present process. Further, the higher pH avoids or minimizes scaling, for example, by calcium sulfate and/or metal thiocyanates such as copper thiocyanate.

The pH ranges successfully employed in the present invention are possible because the present invention is preferably conducted on fresh carbon-in-pulp (CIP) or carbon-in-leach (CIL) tails. In contrast, previous acidification-volatilization-reneutralization (AVR) processes were employed on decant water or on barren bleed from Merrill-Crowe gold cyanidation processes. In the present process, much of the cyanide in the waste stream is in ionic form or only weakly complexed, whereas in barren bleed there is significant complexing including insoluble and strongly complexed forms. Therefore, previous AVR processes optimized the acidic precipitation of some of the metallo-complexes in order to deal with such precipitates separately. Use of the instant method for treating cyanide-containing slurries has additional advantages when used in combination with a CIL or CIP process. Recycling recovered cyanide and the low levels of effluent cyanide permits higher cyanide levels to be used in the leaching process which provides higher recoveries of precious metal values.

SUMMARY OF THE INVENTION

In accordance with the present invention, a process is provided for regenerating cyanide from a cyanide-containing mixture. The process includes the steps of: (1) adjusting the pH of the cyanide-containing mixture to between about 6 and about 9.5, (2) volatilizing the hydrogen cyanide (HCN) contained in the pH adjusted mixture, and (3) contacting the volatilized HCN with basic material.

In another embodiment, the instant invention involves a process for regenerating cyanide from alkaline, cyanide-containing solution while minimizing equipment fouling due to solids precipitation. The method comprises (a) adjusting the pH of the cyanide-containing solution to between about 7 and about 9.5 to provide a pH adjusted solution; (b) passing a gas through the pH adjusted solution to remove HCN from the pH adjusted solution and form a HCN-gas mixture; and (c) contacting the HCN-gas mixture with an aqueous alkaline solution to form a cyanide-containing solution.

In another embodiment, the instant invention comprises an apparatus for regenerating cyanide values from an alkaline, cyanide-containing slurry. The apparatus comprises a zone for adjusting the pH of the slurry to a pH of between about 6 and about 9.5 to form a pH adjusted slurry. An HCN volatilization zone is adapted to receive the pH adjusted slurry and contact the slurry with a volatilization gas to form a HCN-gas mixture. A cyanide recovery zone is adapted to receive the HCN-gas mixture and contact the mixture with a basic material to form a cyanide salt.

In another embodiment the instant invention involves an improved method for recovering metal values from an ore. The method involves leaching the ore with a cyanide-containing solution at a pH of at least about 10 to provide a cyanide-containing slurry having dissolved metal values. The cyanide-containing slurry is contacted with activated carbon to load the carbon with the dissolved metal values. The loaded carbon is separated from the slurry to form a barren slurry having reduced dissolved metal values. The pH of the barren slurry is adjusted from above about 10 to between about 6 and about 9.5 to provide a pH adjusted slurry. A volatilization gas is passed through the pH adjusted slurry to form a HCN-gas mixture. The HCN-gas mixture is removed from the pH adjusted slurry and contacted with a basic solution to form a cyanide-containing solution. The cyanide-containing solution is then returned to the leaching step.

DETAILED DESCRIPTION OF THE INVENTION

Figure 1:
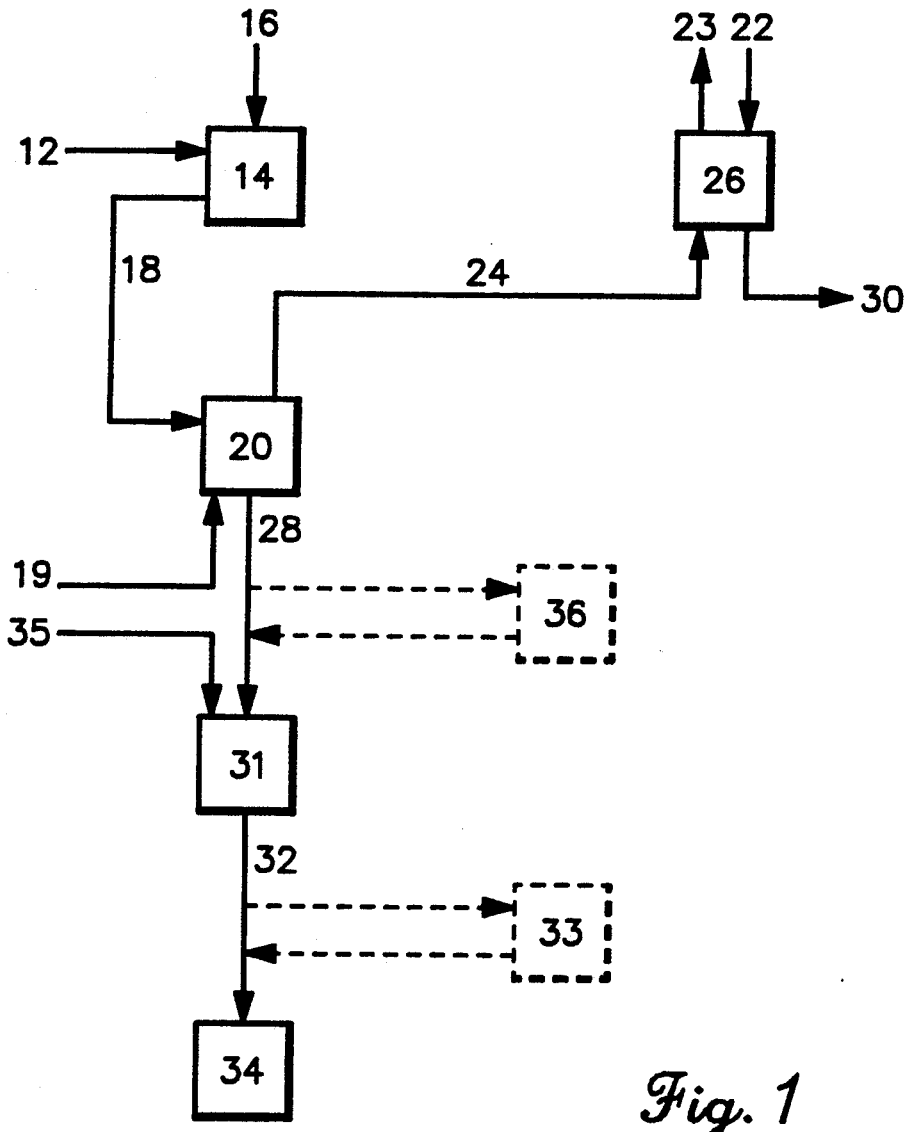
FIG. 1 is a block diagram of one embodiment of the present invention.

The present invention concerns a process for regenerating cyanide from cyanide-containing waste streams. The process is preferably performed on tailings slurries resulting from mineral recovery processes, e.g. gold recovery processes employing cyanide leach solutions, such as vat leach, carbon-in-leach, and carbon-in-pulp processes. Such tailings slurries typically have a pH of greater than about 10, contain about 25% to 40% by weight solids and about 10 to 1000, more typically 100 to 600 ppm cyanide.

The recovery of cyanide from slurries is advantageous for a number of reasons. Elimination of sedimentation or clarification steps reduces both capital and operating costs for the process. The recovery of cyanide can significantly reduce operating costs and the hazards associated with the manufacture, transport and storage of the reagent. Reduction of the total and weak acid dissociable (WAD) cyanide content entering the tailings impoundment minimizes the toxic effects of cyanide on wildlife and significantly reduces the potential for generation of leachate containing unacceptable levels of metals and cyanide. The requirement for installing a lining in the tailings impoundment can be eliminated for many applications. The reduction of total cyanide to acceptable levels in mine backfill can eliminate the need for wash plants in some circumstances. The reduction of total cyanide and metals concentration in the decant water and associated cyanide waste waters significantly decreases the costs while increasing the reliability and performance of downstream treatment processes. The generation of undesirable treatment byproducts such as ammonia and cyanate can be minimized thereby reducing significant capital outlays required for treatment of such materials. Additionally, the recovery and recycle of a substantial amount of cyanide from mineral recovery streams particularly from vat leaching, CIL and CIP tailings permits higher levels of cyanide to be used in the leach resulting in higher and more rapid recovery of precious metal values.

The cyanide feed streams from minerals recovery processes are typically at a pH above 9 and normally above 10. A first step in the cyanide recovery process involves adjusting the pH of the stream of the cyanide-containing mixture being treated to between about 6 and about 9.5, more preferably between about 7 and 9, and most preferably to about 8. This can be accomplished through the use of an acidifying agent. Using a near neutral or basic pH minimizes problems associated with an increase in sulfate and total dissolved solids concentrations which can result in precipitation of materials such as calcium sulfate. Proper adjustment of the pH results in the formation of HCN in solution. The HCN is volatilized, preferably by contacting with air. The volatilized HCN is then contacted with a basic material, preferably in a solution having a pH between about 11 and 12, to convert the HCN to a cyanide salt.

The tailings remaining after the HCN volatilization step can be further treated to remove remaining cyanide and/or metals and metal complexes. Such optional treatment can include metal coagulation, pH adjustment of the tailings in order to precipitate metal complexes, and/or further cyanide removal by known treatments such as oxidation (e.g. with $H_2O_2$ or $SO_2$) and/or biological treatments.

As a result of the process of the present invention, treated ore tailings have a greater long-term stability. Potentially toxic species (e.g. silver) will be less likely to be mobilized because of the lower cyanide concentration in the tailings pond. Discharge concentrations can be lowered and management requirements after mine closure reduced.

Previous cyanide recovery processes have used a low pH precipitation step. This is to be contrasted with the present process which instead uses a pH in the range of about 6 to about 9.5. An advantage of using a near neutral or basic pH is that the formation of solids, such as calcium sulfate, is minimized which avoids scaling and fouling of equipment. This can be particularly important when packed towers are used to volatilize the HCN. Another advantage is that the higher pH reduces the amount of acid required to be added to initially acidify the waste stream. The amount of base required to subsequently raise the pH of the treated stream is also reduced.

With reference to FIG. 1, a cyanide-containing waste stream 12 is treated in a pH adjustment zone 14 in order to obtain a stream having a pH between about 6 and about 9.5 and more preferably between about 7 and about 9 and most preferably about 8. A cyanide-containing slurry stream from any minerals recovery process can be used as a feed for the instant cyanide recovery process. In a preferred embodiment, the cyanide-containing waste stream is a tailings slurry from a vat leach which can use a precipitation method such as with zinc to recover metal values, or, a carbon-in-pulp or a carbon-in-leach metal recovery process which tailings normally have a pH above about 10 and normally in the range of about 10.5 to 11.5, a solids content of between about 20% and 50% by weight, more typically 25% to 40% by weight and about 100 to 600 ppm cyanide. Normally, it is not advantageous to lower the pH of the feed to below about 6. Based upon dissociation constants more rapid recovery of free cyanide and weakly bound cyanide e.g., NaCN and $Zn(CN)_2$, can be accomplished at a pH in the range of 4.5 to 8.5, whereas for a weak acid dissociable (WAD) cyanide, a pH of about 4.0 is optimal. However, it has been found that the instant process provides a high recovery of the ionic cyanide and unexpectedly, a substantial recovery of the WAD cyanide even at a pH of 6 or above. For the reasons set forth hereinabove, a near neutral or basic pH of between about 6 and about 9.5, more preferably about 7 and about 9, is preferred to minimize precipitation problems. Additionally, at pH ranges below about 3 or 4, some metal complexes, e.g. $Cu(CN)_2$, will precipitate and subsequently resolubilize when the pH is increased. The dissolution of metals such as iron, copper, nickel, etc. is also minimized when a pH of at least about 6 is used.

The cyanide-containing stream 12 is acidified in zone 14 by adding an acidifying agent 16. The acidifying agent 16 is preferably $H_2SO_4$, but other mineral acids can be used such as hydrochloric acid, nitric acid, phosphoric acid, $H_2SO_3$, mixtures of $H_2SO_3$ and $SO_2$, etc. or organic acids such as acetic acid, as well as mixtures of acids. The particular acidifying agent of choice depends on such factors as economics, particularly the availability of acidic streams from other processes, and the composition of the stream being treated. For example, if the stream contains materials which are detrimentally affected by an oxidizing agent, nitric acid would probably not be useful. A potential problem which was anticipated prior to the reduction to practice of the present invention was the formation of $CaSO_4$ precipitates upon addition of $H_2SO_4$ to slurries containing ore tailings. Surprisingly, this problem was not found to be as severe as originally anticipated and sulfuric acid can be readily used in connection with the packed tower embodiment set forth hereinbelow. The function of the acidifying agent 16 is to reduce the pH in order to shift the equilibrium from cyanide/metal complexes to $CN^-$ and ultimately to HCN. By employing higher pH ranges than those used in prior art AVR processes, the amount of acidifying agent 16 required is substantially reduced and the other advantages set forth hereinabove can be obtained.

A pH adjusted stream is then transferred 18 from zone 14 to a volatilization zone 20 as shown in FIG. 1. In the volatilization zone 20, HCN is transferred from the liquid phase to the gas phase using a volatilization gas 19. Air is a preferred volatilization gas although other gases such as purified nitrogen can be used. The gas can also provide the turbulence required. Air can be introduced into the pH adjusted mixture in the volatilization zone 20 by any method well known in the art. For example, a diffuser basin or channel can be used without mechanical dispersion of the air. Alternatively, an air sparged vessel and impeller for dispersion can be employed. Baffles can be arranged in the vessel, e.g., radially, to assist in agitation of the slurry. In other alternative embodiments, a modified flotation device or a countercurrent flow tower with a grid, a plurality of grids, packing, a plurality of trays, etc., can be used.

Volatilization of HCN by gas stripping involves the passage of a large volume of low pressure compressed gas through the acidified mixture to release cyanide from solution in the form of HCN gas. Alternatively, the mixture can be contacted with the volatilization gas, e.g. in a countercurrent flow tower.

When a stripping reactor is used, the pH adjusted mixture is transferred 18 from the initial pH adjustment zone 14 to the stripping reactor (volatilization zone) 20. Incoming volatilization gas 19 is distributed across the base of the stripping reactor 20 using gas sparger units designed to prevent any solids from entering the gas pipework on cessation of gas flow. Preferably, coarse to medium sized bubbles are used to provide sufficient gas volume and to minimize clogging of gas ports with materials such as clay. The resulting stripping gas stream is continuously removed 24 from the enclosed atmosphere above the slurry in association with removal of the extracted gas stream 23 which is positively withdrawn from the scrubber zone 26 by a device such as a fan. When the volatilization gas is air, the preferred flow is from about 250 to about 1,000 cubic meters of air per cubic meter of pH adjusted mixture per hour, more preferably, about 300 to 800 and most preferably, about 350 to about 700 $m^3/m^3$. This flow is maintained for a time sufficient to remove the desired level of HCN. The time required to accomplish this removal depends on the air flow rate, the slurry feed rate, the slurry depth in the stripping reactor, the pH and the temperature of the mixture. Normally, the stripping can be accomplished in a period of about 2 to 6 hours. Preferably, a flow rate of about 300 to 800 $m^3/m^3$ is used which corresponds to a flux of from 2.8 to 7.4 cubic meters air per square meter of pH adjusted mixture per minute, based on a period of 3 to 4 hours.

While the key function of air in the system is to provide an inert carrier gas and transport, the air also has secondary effects. The first is to provide energy to overcome barriers to HCN transfer to the gas phase. Although HCN is very volatile, having a boiling point of about 26° C., it is also infinitely soluble in water, and HCN solutions have a high degree of hydrogen bonding. Thus, there are significant resistances to the mass transfer of HCN that can be overcome by using the sparged air to provide the necessary energy in the form of turbulence. Furthermore, the dissociation equilibrium constants for most of the metal-cyanide complexes are low at the desired pH ranges; therefore, it is necessary for the $CN^-$ concentration to be close to zero in order to push the equilibrium far enough toward $CN^-$ formation in order to substantially dissociate the complexes. This can be achieved by efficient formation of HCN from $CN^-$, which is pH dependent, and then by removal of HCN from the solution, which is energy dependent.

As indicated above, preferred retention time in the volatilization zone 20 is from about 2 to about 6 hours with a stripping reactor. In a stripping reactor, the liquid height in the reactor is preferably less than about 3 meters. This preferred depth is due to the function of air in the system and the possibility of bubble coalescence if the depth is greater than about 3 meters. The necessary retention time can be achieved by using a single reactor or a plurality of reactors arranged in parallel, in series or a combination, as is appropriate for the particular feed stream and throughput. For example, multiple trains of reactors can be arranged in parallel with a plurality of stripping reactors arranged in series in each train.

The stream of volatilized HCN and volatilization gas is removed from zone 20 and transferred into a cyanide recovery zone 26. The apparatus useful in the cyanide recovery zone should provide effective mixing of the basic material being added and the stream of volatilized HCN. Suitable apparatus includes a gas sparger, preferably in an agitated vessel, which can provide effective contact of the HCN containing gas with the basic solution. More preferably, a conventional packed countercurrent scrubber is used (126 shown in FIG. 2). Basic material, preferably in solution, is fed 22 to the recovery zone 26. The recovery solution is preferably at a pH of at least about 11 and preferably between about 11 and about 12, in order to absorb HCN gas. Any basic material capable of providing a solution having the desired pH can be used. Examples of such materials include sodium hydroxide, potassium hydroxide, calcium hydroxide, lime, calcium carbonate, sodium carbonate, etc. Calcium-containing materials are generally not preferred because of the potential for the formation of $CaSO_4$ scale. Sodium hydroxide is generally preferred. The basic cyanide solution 30 can be recycled, e.g. to a mineral recovery process such as a gold cyanidation process.

The treated tailings which remain in reactor 20 after the HCN volatilization step can be removed 28 and contacted in zone 31 with alkaline material 35 to readjust the pH upward to a range of about 9.5 to about 10.5 in order to precipitate metals. Generally lime, limestone or lime water are preferred basic materials due to cost. The resulting pH adjusted tailings 32 can then be impounded 34. Optionally, prior to the pH adjustment step 31, complexed metals can be coagulated 36 (shown in phantom) by methods known in the art, for example using $FeCl_3$ or TMT, an organic sulfide available from DeGussa Corporation. Additional cyanide can also be removed 33 (shown in phantom) from the pH adjusted tailings 32, for example by known oxidation techniques, e.g. using $H_2O_2$or $SO_2$, or by known biological processes.

Figure 2:
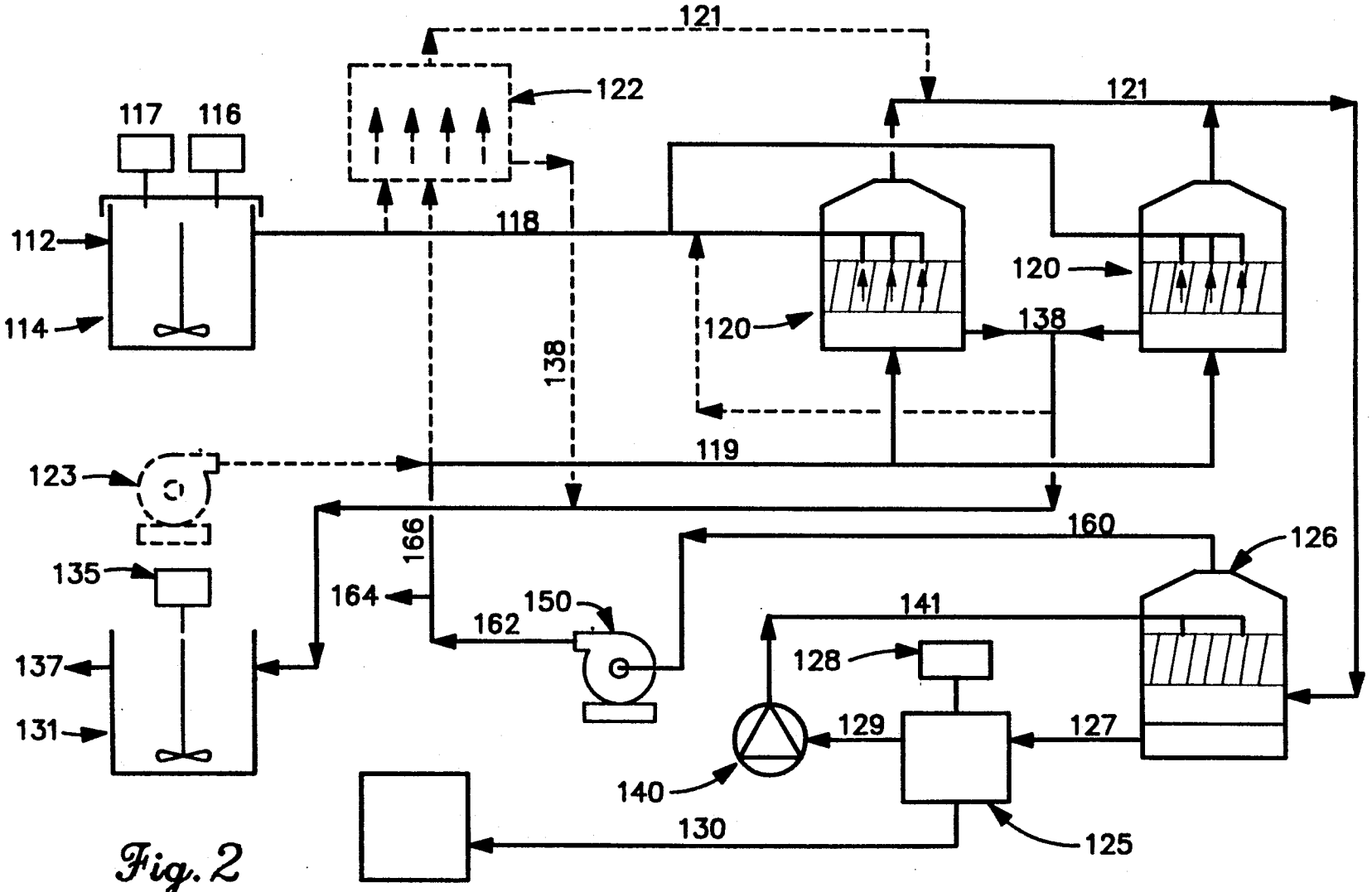
FIG. 2 illustrates a preferred embodiment of the cyanide recovery process of the present invention.

A preferred embodiment of the process for removing and recovering cyanide values from a slurry is shown in FIG. 2. The pH of an incoming mill tailings slurry 112 is adjusted downward from a pH of above about 10 to between about 6 and about 9.5. This is accomplished in a sealed, agitated reactor vessel 114 normally in approximately a 5 to 20 minute time period. The vessel 114 should be constructed of materials compatible with the abrasive nature of this process. The acidifying agent 116, preferably the $H_2SO_4$ shown, is normally added in the form of an aqueous solution normally containing about 10 weight percent acid. Once the pH of the slurry has been adjusted to the range of about 6 to 9.5, the pH adjusted slurry is transferred 118 to the volatilization section 120. Preferably, at least one packed tower is used in which the slurry is passed in countercurrent flow to the volatilization gas.

A packed tower useful in the instant process normally has a means for distributing the slurry substantially uniformly across the top of the packing material. The means is located near the top of the tower and above the packing medium. It is preferred that the distributing means minimize interference between the slurry and rising volatilization gas to minimize the flow disturbance and provide an effective distribution of the slurry over a substantial cross-sectional area of the packing material. For example, a multiple weir, V-notch assembly can be used. The distributing means can be made of any suitable material such as steel or ceramic. The tower can also be equipped with a demister. The demister functions to suppress or disperse aerosols and can be formed from a fine screen or grid, glass wool or other porous media, etc.

The packing material useful in the tower can be any mass-transfer media which provides a high void ratio, i.e., a high surface area to volume ratio (e.g. square meter per cubic meter). Preferably, the void ratio is above 50%, more preferably above 80% and most preferably above 85%. The openings in the packing material must be sufficiently large to allow free passage of the particles contained in the slurry. The height of the packing is typically 3 to 10 meters, more preferably 4 to 8 meters, most preferably about 6 to 7 meters depending on the desired pressure drop.

To maximize efficiency of the process, it is important to control the viscosity of the slurry entering the packed tower. It has been found that increasing the viscosity of the slurry within an operative range improves the mass transfer and removal of hydrogen cyanide from the solution. However, if the viscosity is too high, flow of the slurry through the packing can be affected with subsequent operating problems and a decrease in removal of the hydrogen cyanide. The viscosity of the slurry is affected by the percent solids contained in the slurry, the type of ore being treated, and the temperature of the slurry. Normally, the weight percent solids in the slurry should not exceed about 60 weight percent. Preferably, no more than about 50 weight percent solids should be contained in the slurry. More preferably, the slurry should contain between about 25 and 45 weight percent solids.

As set forth hereinabove, the packing material should have a high void ratio. The packing can be any material which can withstand the abrasion and operating conditions in the packed tower. Preferred materials include stainless steel, ceramic materials and plastic materials, for example, polyethylene and polypropylene. Examples of packing materials which have been found to be effective include 50 mm and 75 mm Pall rings, Rashig rings, Tellerette, saddles, and grid, although it is anticipated that other packing materials can be used. The tower can be constructed from any material capable of withstanding the reaction conditions and the chemicals which contact the internal surface of the tower. The preferred materials include fiberglass, steel (both mild and stainless) and concrete.

In an alternative configuration, a stripping reactor 122 can be used as discussed for FIG. 1 and as depicted in phantom in FIG. 2. Such a reactor would normally be used in place of the stripping tower 120.

In operation of the stripping tower, the volatilization gas, preferably air, is conveyed 119 to the stripping tower 120. Although two towers are depicted in FIG. 2, it is contemplated that, depending on the amount of slurry to be treated and the size of the tower, a single tower could be used. Alternatively, a plurality of stripping towers can be used either in parallel as depicted in FIG. 2 or in series or a combination of parallel trains with each train containing a plurality of towers arranged in series. The towers can be arranged to provide a single pass of the slurry as depicted in FIG. 2 or multiple passes with the slurry being recycled.

In the operation depicted in FIG. 2, air is introduced into the stripping tower in countercurrent flow to the slurry. The air can be introduced by blower 123 shown in phantom or air can be forced through by negation pressure induced by fan 150. The tower is operated under a negative pressure with the air-HCN mixture being positively removed through line 121 and transported to a cyanide recovery section. In the configuration of FIG. 2, the fan 150 is operated to exceed the flow of stripping gas so that all of the system above the packing in tower 120 through vessel 126 operates under negative pressure to minimize any leaking of HCN. Preferably, the air is recycled as discussed hereinbelow. Sufficient air is introduced into the volatilization tower to provide a mean volume to volume ratio of air to slurry of about 250 to 1,000, more preferably in the range of 300 to 800, and most preferably, in the range of 350 to 700. Preferably, a pressure drop of about 15 millimeters (mm) to about 30 mm water gauge per meter of packing height is maintained. The pressure drop is the difference in pressure between the top and bottom of the tower, the air flow or air flux and the cross-sectional area of the tower. The degree of flooding is based upon filling all of the void space in the tower being considered 100% flooding.

The slurry is fed to the packed tower at a rate which maintains a desired pressure drop over the length of the tower. Normally, the tower is operated in the range of about 10% to about 70% of the flooding volume and preferably, in a range of about 20% to about 50% of the flooding volume.

The air-HCN mixture is conveyed 121 to the cyanide recovery section 126. Preferably, the cyanide recovery takes place in a packed tower by contacting the HCN with a basic solution which is conveyed in countercurrent flow to the HCN-containing gas. As discussed hereinabove for FIG. 1, any appropriate basic material capable of providing an aqueous solution with a pH of at least about 11 can be used. Sodium hydroxide is preferred in order to reduce calcium in the circuit and reduce possible calcium sulfate precipitation and scale formation. Minimizing such scale formation can be particularly important with the packed tower in order to minimize packing media fouling. As depicted in FIG. 2, in a preferred embodiment, sodium hydroxide solution 128 is added to vessel 125 where it is combined with cyanide containing stream 127 from scrubber 126. Caustic stream 129 is removed from vessel 125 by pump 140 and conveyed 141 to be used to scrub hydrogen-cyanide containing gas in the cyanide recovery section 126. The air-HCN mixture is drawn through the scrubber column. As depicted in FIG. 2, the scrubber column is vertical but the column can be horizontal or any other suitable configuration. Additionally, although a single column is depicted, it is recognized that a plurality of columns could be used as necessary to effectively scrub the volume of gas. The columns can be arranged in series or in parallel as desired. The column is preferably packed with a media bed to provide efficient contact between the HCN and the basic solution. The media can be any packing capable of providing effective contact between a gas and liquid, with such media being well-known to those skilled in the art. A proportion of the caustic-cyanide solution in vessel 125 bled off 130 to prevent the continuous build-up of cyanide removed from the HCN-air mixture introduced 121. Sodium hydroxide 128 is automatically dosed into the scrubber liquid to maintain a constant pH thereby allowing for the portion lost to bleed. Cyanide, now in the form of a caustic solution of sodium cyanide bleed 130, is returned to the mill circuit for reuse.

Scrubbed air is removed 160 from the scrubber 126 and is conveyed through fan 150 to line 162 for recycle or venting to the atmosphere provided the air contains a low enough level of hydrogen cyanide. Scrubbed air can be discharged to the atmosphere by a line 164. Gas monitoring equipment can be installed in connection with line 162 to provide a continuous readout of performance and can include detection of levels of cyanide. Preferably, the scrubbing unit 126 allows for a minimum of 98% HCN removal from the hydrogen cyanide-gas mixture. On this basis, the concentration of HCN exiting the scrubber bed is maintained at less than 10 milligrams per cubic meter. Preferably, the scrubbed air is recycled to the volatilization section gas feed 119 through line 166.

The stripped tailings slurry is removed 138 from the volatilization tower and transported to a reneutralization section 131 which is preferably a sealed, agitated vessel. The vessel 131 is constructed of materials compatible with the abrasive nature of this process. A basic material 135 is added to provide the desired pH level for the final slurry. Although any suitable base such as sodium hydroxide or potassium hydroxide can be used, it is preferred that sodium carbonate, calcium oxide or calcium hydroxide be used to minimize the cost. The normal residence time to accomplish the reneutralization and retain the desired pH level for the slurry is normally about 15 minutes to 1 hour. The necessary time depends upon the buffering curve of the components contained in the slurry.

The adjusted slurry is removed 137 from the reneutralization section and transported to a tailings impoundment. Alternatively, the adjusted tailings can be treated to remove the remaining cyanide or can be transferred to a thickener (not shown) where the coarse material is removed and deposited in an impoundment with the decant being additionally treated to remove the remaining cyanide. The treatment can be accomplished by recycling the whole stream or decant into the feedstream 112 for the pH adjustment section.

Figure 3:
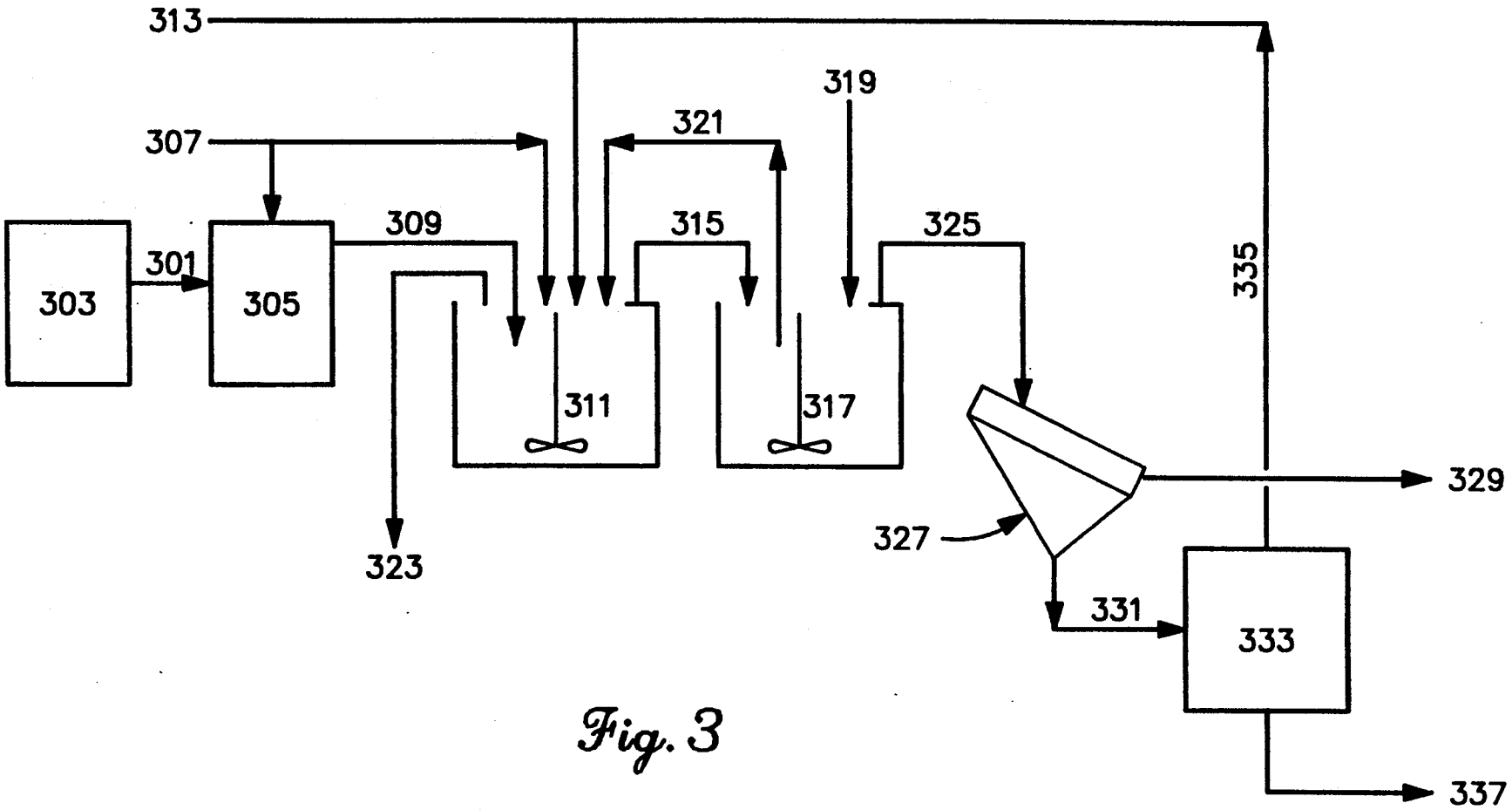
FIG. 3 illustrates a carbon-in-leach process in combination with the cyanide recovery process.

Referring to FIG. 3, the use of the instant cyanide recovery process in combination with a carbon-in-leach process is depicted. Although the CIL process as depicted has no cyanide leach without carbon, it is contemplated that some CIL processes can use at least a partial cyanide leach prior to introduction of the carbon. The ore slurry 301 suitable for treatment by a CIL process is prepared by well-known processes 303. An oxidation process can be used to treat refractory ores. The pH of the slurry is adjusted in zone 305 preferably to above about 10, more preferably in the range of about 10.5 to 11 by adding a basic material 307, preferably lime. The resulting alkaline slurry is transferred 309 to the carbon-in-leach process. A typical CIL process is described in U.S. Pat. No. 4,289,532 of Matson et al. (issued 1981) incorporated herein by reference.

In the carbon-in-leach circuit, the slurry is simultaneously contacted with cyanide and granular activated carbon in vessel 311. The carbon moves countercurrent with the flow of the slurry. Thus, in FIG. 3, stream 309 enters the first mixing vessel 311 where it contacts a cyanide stream 313 which can contain cyanide in the amount of between about 0.25 and 2.5 pounds of cyanide expressed as sodium cyanide per ton of dry ore as disclosed in the Matson et al. '532 patent. The cyanide can be added in solid form, but it may also be added as a solution, for example, as a sodium cyanide solution having between about 10 and about 25 weight percent sodium cyanide by weight. Other sources of cyanide such as potassium cyanide and calcium cyanide can be used, as is well known in the art. Additional lime 307 can be added to maintain the pH above about 10 in order to decrease cyanide decomposition. A stream of the slurry is removed 315 and transferred to a second agitated vessel 317. Activated carbon is screened from the slurry being transferred to vessel 317. Fresh activated carbon is introduced 319 to vessel 317. A slurry containing cyanide ore and activated carbon is transferred 321 back to vessel 311. A slurry containing loaded carbon is removed 323 from vessel 311 for subsequent recovery of precious metals by methods such as stripping and electro-winning which are well known in the art. A slurry which has been screened to remove the activated carbon is removed 325 from vessel 317 and preferably conveyed to a separation device 327, such as a screen, which removes any contained carbon as stream 329. The remaining ore tailings are transferred 331 as a feed to the instant cyanide recovery process 333 which is depicted in detail in FIG. 2. Sodium cyanide containing solution (depicted as stream 130 in FIG. 2) is removed 335 from the process and recycled to the CIL process. Tailings 337 from the process are disposed of as discussed hereinabove.

Use of the instant cyanide recovery process permits the use of higher levels of cyanide in the CIL process. The levels of cyanide used based on sodium cyanide can be increased by up to 250%, more typically up to 100%, most typically up to 50%.

Figure 4:
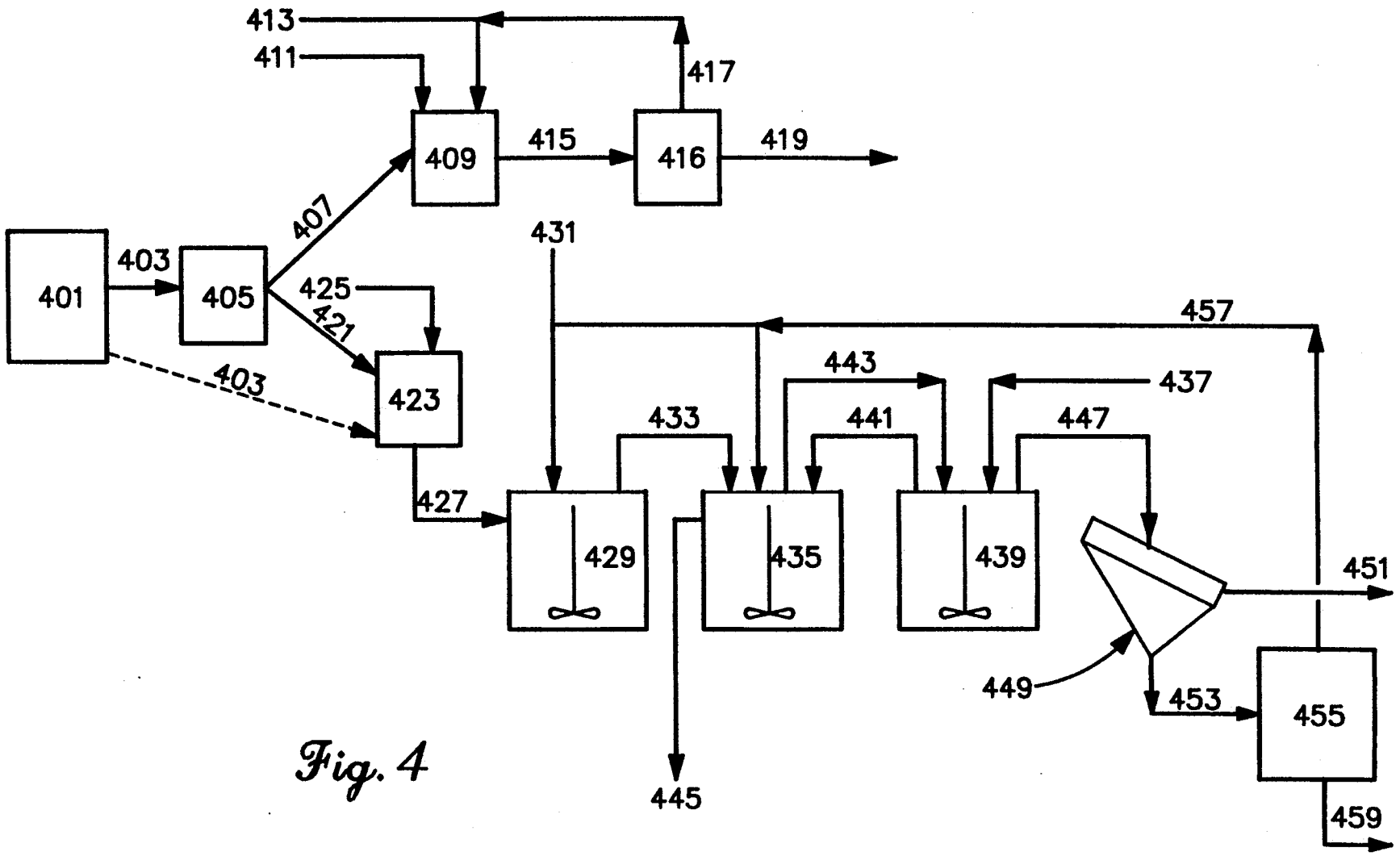
FIG. 4 illustrates a carbon-in-pulp process in combination with the cyanide recovery process.

Referring to FIG. 4, a carbon-in-pulp process is depicted using the cyanide recovery process of the present invention. A typical CIP process is described in U.S. Pat. No. 4,578,163 of Kunter et al. (issued 1986). Ore is prepared in mill 401 and transferred 403 optionally to a classification device 405, such as a cyclone, which classifies the ore into sands and slimes. This classification is used where necessary depending on the ore and whether the sand is to be used as backfill. The sands are conveyed 407 to a vat 409 where the pH of the sand is adjusted to the desired pH range by the use of a basic material 411 such as lime. The vat can be agitated or can be a stationary bed. If a stationary bed of the sand is used, it can be leached using a sodium cyanide solution 413 containing about 0.045 to about 0.055 weight percent sodium cyanide by percolating the solution by gravity through the sand. If the vat is agitated, then a solution containing about 1 pound of cyanide per ton of ore is used. The sand residue from the process is transferred 415 as a feed to the cyanide recovery 416 process depicted in FIG. 2. The recovered sodium cyanide solution (corresponding to stream 130 of FIG. 2) is recycled 417 to be used as feed for leaching the ore in the vat. The tailings are removed 419 for subsequent treatment as discussed hereinabove.

The slime which is separated from the sand by apparatus 405 is transferred 421 to a carbon-in-pulp process. Optionally, the ore slurry 403 can be transferred directly from mill 401 to vessel 423 as depicted in phantom. The slime is introduced into the pH adjustment vessel 423 to which a basic material such as lime is added 425 to increase the pH typically to at least about 10 and preferably at least about 10.5. The resulting alkaline slurry is transferred 427 to an agitated vessel 429 to which cyanide 431 is added to provide a final concentration of about 1 pound based on sodium cyanide per ton of slurry. The pulp slurry fed to vessel 429 preferably has a solids content of about 40 weight percent. Pulp from the cyanidation tank 429 is transferred 433 to at least one and normally, a plurality of carbon-in-pulp vessels 435 and 439. As depicted in U.S. Pat. No. 4,578,163 of Kunter et al., normally four or more carbon-in-pulp vessels are operated in series to effect a countercurrent extraction with the activated carbon. The activated carbon 437 is fed to the final vessel 439 of the series. A slurry containing activated carbon is transferred 441 from vessel 439 to vessel 435. Simultaneously, a slurry, from which the activated carbon has been separated, is transferred 443 from vessel 435 to vessel 439. Loaded activated carbon is removed 445 from vessel 435 and precious metal values are subsequently removed from the carbon. A slurry stream, from which the activated carbon is substantially removed, is transferred 447 from vessel 439 to a separation means 449 which removes any remaining activated carbon as a stream 451. The remaining tailings are transferred 453 to the cyanide recovery process 455 which is depicted in detail in FIG. 2. A sodium cyanide solution (corresponding to stream 130 of FIG. 2) is transferred 457 to be recycled and used in the carbon-in-pulp process. The tailings from process 455 are removed 459 for disposal as discussed hereinabove.

Although two separate cyanide recovery processes are depicted in FIG. 4, a single cyanide recovery process can be used if the different sizes of the particles in the sand slurry and slime slurry permit. Even if two separate processes are used, sodium cyanide solution can, of course, be recycled to either portion of the process.

Use of the cyanide recovery process of the instant invention similarly permits higher levels of cyanide to be used particularly in the carbon-in-pulp. The level of cyanide can be readily increased by at least about 50%, preferably up to 100% and preferably by at least about 250%.

While not wishing to be bound by any mechanism, it is believed that the cyanide recovery process of the present invention operates as follows.

When the pH of the tailings is adjusted to between 6 and 9.5, the $CN^-$ complexes (with the exception of Fe and Co complexes) dissociate to form $CN^-$ and ultimately HCN:

$$\text{CN complexes} \;=\;=\;=\;=\;=\; CN^- \;=\;=\;=\;=\;=\; HCN$$

These equations represent equilibrium reactions in which the process of the present invention shifts the equilibrium to the right-hand side. In the volatilization section 20 of FIG. 1, the HCN in solution is volatilized to HCN gas:

$$\text{HCNsolution} \;\text{-----}\; \text{HCNgas}$$

This preferably occurs under an overall pH of about 8 and a high energy environment of the volatilization section 20. IN the basic reaction chamber 26, the high pH causes the equilibrium to shift back towards HCN in solution:

$$\text{HCNgas} \;\text{---------}\; \text{HCNsolution}$$

Although the process has been described with reference to tailings slurry from a carbon-in-leach or carbon-in-pulp mineral recovery process, it is to be expressly understood that the process can also be employed on other cyanide-containing streams, e.g. from other mineral recovery processes, electro-plating processes, etc.

The following experimental results are provided for the purpose of illustration of the present invention and are not intended to limit the scope of the invention.

EXAMPLES

A. Equipment

The apparatus employed in Examples 1 and 2 consists of two 3' plexiglass columns six inches in diameter, connected in series, and sealed on both ends with plexiglass plates. The two columns are connected by tubing to permit the flow of air into the bottom of the first column, up through the column where it exits at the top, and then enters the bottom of the second column, flows through the column and exits at the top of the second column. A flow meter was employed to measure the flow of air entering the bottom of the first column. The column nearest the flow meter operated as the acidification-volatilization column, while the second column operated as the absorption column. Tubing was attached to the absorption column and ran into a fume hood to vent the air and any cyanide not absorbed.

The aeration system was capable of producing a continuous flow of air in the range of 0–10 scfm at pressures of 10–20 psi. A compressor was employed for this purpose. The compressor was attached to the flow meter via tubing which was then attached to the first column. A regulator between the compressor and the flow meter was employed to regulate and record the pressure being applied to the system.

A pipe was attached in each bottom plate of the two columns to facilitate sampling and draining of the columns during and following an experiment.

B. Procedure

In Examples 1, 2 and 3, a specific pH and air flow were utilized and the extent of cyanide stripping and recovery was evaluated over time. The air flow passed from the compressor, through the regulator, the flow meter, and the first volatilization column, and finally through the second absorption column. The air flow exiting the second column passed into a fume hood to vent unabsorbed cyanide.

EXAMPLE 1

The ore used in Example 1 was prepared by grinding 25 kilograms of ore together with 13.5 kilograms of water (i.e. 65% solids) and 240 grams of $Ca(OH)_2$ (i.e. 9.6 kilograms per ton) for 42 minutes in order to achieve a particle size distribution of about 85% of the ore less than 45 microns in size. Twenty kilograms of water were added after grinding in order to thin the slurry. The slurry was ground a total of 3 times. Makeup water (9.6 kilograms) was added at the completion of the three grinds and the pH was adjusted to 10.5.

The slurry was leached with cyanide. Initially, 83.5 grams of NaCN as a 5% solution was added. After 2 hours, 33 additional grams of NaCN (5% solution) was added as the cyanide concentration had dropped. The total cyanide added to the system was equivalent to 385 parts per million cyanide. During leaching, an air flow of 1 liter per minute was maintained. The pH and cyanide concentration of the leach slurry was monitored hourly. No further additions of NaCN were needed. The final cyanide concentration was measured at 210 parts per million. Finally, carbon was added after 16 hours. However, the gold and silver concentrations were not monitored. After removal of the carbon, the composition of the barren leachate was measured prior to stripping. The composition is shown in Table I.

TABLE I

| Composition of Barren Leachate Before Stripping | |
|---|---|
| pH | 10.3 |
| Alkalinity | 475 |
| Ammonia-N | 1 |
| Cyanate | 23 |
| Cyanide (Total) | 202, 192 |
| Cyanide (WAD) | 200, 190 |
| Sulphate | 320 |
| Thiocyanate | 24 |
| Arsenic | 0.8 |
| Copper | 3.90 |
| Iron | 0.15 |
| Silver | 0.06 |
| Zinc | 2.10 |

For each of the six runs of Example 1, 10 liters of the slurry prepared as described above were placed in the first volatilization column. Initial samples of the solution were analyzed for free cyanide (for example, by ion selective electrode or by silver nitrate titration), the weak acid dissociable cyanide ($CN_{WAD}$—by ASTM Method C), and pH. For runs 1 and 2 the initial pH was not adjusted. For runs 3 and 4 the pH was adjusted with $H_2SO_4$ to 8.7. For runs 5 and 6 the pH was adjusted to 7.6.

Ten liters of caustic solution was placed in column 2 (the absorption column). The caustic solution was prepared by adding sufficient sodium hydroxide pellets to bring the pH of the solution to about 11 to about 11.5.

Air was then introduced into the columns. In runs 1, 3 and 5, the air flow rate was 60 liters per minute (±20%) and in runs 2, 4 and 6, the air flow rate was 82 liters per minute (±20%). Table II summarizes the pH and air flow rates for each of the runs in Example 1.

TABLE II

| | Conditions for Stripping | | | | | |
|---|---|---|---|---|---|---|
| | Run No. | | | | | |
| | 1 | 2 | 3 | 4 | 5 | 6 |
| pH | 10.5 | 10.5 | 8.7 | 8.7 | 7.6 | 7.6 |
| air flow (l/min) ±20% | 60 | 82 | 60 | 82 | 60 | 82 |

The amount of total cyanide ($CN_T$) and Method C cyanide ($CN_{WAD}$) was measured both in parts per million and in milligrams for the slurry in column 1 and the caustic solution in column 2. The results are shown in Table III.

The first column labeled "Hours Stripping" lists the six runs and the time each sample was taken. The second column labeled "Kilograms in System" is the kilograms of liquor in the first column. Initially, 10 kilograms of total slurry was added, made up of liquor and solid tailings. The third and fourth columns list the $CN_T$ and $CN_{WAD}$ measurements in parts per million for each run at each time period listed. The fifth and sixth columns list the $CN_T$ and $CN_{WAD}$ in milligrams. The seventh and eighth columns list the same measurements as in the sixth and seventh columns except they have been adjusted as to account for the samples which were removed.

Columns 2 through 8 list measurements taken from the slurry in column 1. Columns 9 through 14 list similar measurements which were performed on the caustic solution in column 2 in order to determine the total amount of cyanide absorbed. The percent extraction of $CN_T$ and $CN_{WAD}$ are listed in columns 15 and 16.

The percentage extraction of $CN_T$ is based on the total $CN_T$ figure for that particular hour and includes the adjustments. The extraction percentages are low because the CN drained from the slurry column is actually not available for stripping. A caustic sample was lost in run number 4 and therefore there are no corresponding numbers. In runs 1 and 2 the milligram $CN_{WAD}$ analysis was not performed on the slurry.

The 10 liters of initial slurry for runs 3 and 4 required 75 milliliters of a 10 volume percent sulfuric acid solution to reduce the pH to 8.7. For runs 5 and 6, 115 milliliters of a 10 volume percent $H_2SO_4$ solution was added to the 10 liters of slurry to reduce the pH to 7.6.

TABLE III

| | Analyses and Balances of Cyanide | | | | | | | | | | | | | | |
|---|---|---|---|---|---|---|---|---|---|---|---|---|---|---|---|
| HOURS | SLURRY | | | | | | | CAUSTIC | | | | | | | |
| STRIP- | kg.* in | ppm CN | | mg CN | | ADJ. ϕmg CN | | kg. in | ppm | mg | ADJ. | Total CN | | % Extn | |
| PING | system | T | WAD | T | WAD | T | WAD | system | CN | CN | mg CN | T | WAD | T | WAD |
| RUN 1 | | | | | | | | | | | | | | | |
| 0 | 7.91 | 163 | 162 | 1290 | | 1290 | | 10.0 | 0 | 0 | 0 | 1290 | | | |
| 1 | 7.91 | 158 | 157 | 1250 | | 1250 | | 10.0 | 9.98 | 100 | 100 | 1350 | | 7.4 | |
| 2 | 7.68 | 150 | 147 | 1150 | | 1190 | | 9.64 | 20.3 | 196 | 200 | 1390 | | 14.4 | |
| 3 | 7.50 | 141 | 143 | 1060 | | 1120 | | 9.41 | 29.0 | 273 | 281 | 1400 | | 20.1 | |
| 4 | 7.20 | 134 | 132 | 965 | | 1070 | | 9.12 | 38.1 | 347 | 364 | 1430 | | 25.5 | |
| RUN 2 | | | | | | | | | | | | | | | |
| 0 | 7.87 | 163 | 162 | 1280 | | 1280 | | 10.0 | 0 | 0 | | 1280 | | | |
| 0.9 | 7.87 | 157 | 158 | 1240 | | 1240 | | 10.0 | 13.0 | 130 | 130 | 1370 | | 9.5 | |
| 1.8 | 7.61 | 141 | 142 | 1070 | | 1110 | | 9.55 | 24.7 | 236 | 242 | 1350 | | 17.9 | |
| 2.7 | 7.38 | 136 | 137 | 1000 | | 1070 | | 9.22 | 34.0 | 313 | 327 | 1400 | | 23.4 | |

TABLE III-continued

| HOURS STRIPPING | SLURRY kg.* in system | ppm CN T | ppm CN WAD | mg CN T | mg CN WAD | ADJ. ϕmg CN T | ADJ. ϕmg CN WAD | CAUSTIC kg. in system | ppm CN | mg CN | ADJ. mg CN | Total CN T | Total CN WAD | % Extn T | % Extn WAD |
|---|---|---|---|---|---|---|---|---|---|---|---|---|---|---|---|
| 3.6 | 7.15 | 114 | 114 | 815 | | 920 | | 8.77 | 44.2 | 388 | 417 | 1310 | | 31.8 | |
| RUN 3 | | | | | | | | | | | | | | | |
| 0 | 7.97 | 163 | 162 | 1300 | 1290 | 1300 | 1290 | 10.0 | 0 | 0 | 0 | 1300 | 1290 | | |
| 0.9 | 7.97 | 50.6 | 40 | 403 | 319 | 403 | 319 | 10.0 | 91.3 | 913 | 913 | 1320 | 1230 | 69.2 | 74.2 |
| 1.8 | 7.71 | 26.6 | 18.3 | 205 | 141 | 218 | 151 | 9.51 | 109 | 1040 | 1080 | 1300 | 1230 | 83.1 | 87.8 |
| 2.7 | 7.44 | 20.5 | 11.7 | 153 | 87.0 | 173 | 102 | 9.08 | 116 | 1050 | 1140 | 1310 | 1240 | 87.0 | 91.9 |
| 3.6 | 7.17 | 18.0 | 8.9 | 125 | 63.8 | 155 | 82.3 | 8.65 | 120 | 1040 | 1180 | 1330 | 1260 | 88.7 | 93.7 |
| RUN 4 | | | | | | | | | | | | | | | |
| 0 | 7.91 | 163 | 162 | 1290 | 1280 | 1290 | 1280 | 10.0 | 0 | 0 | 0 | 1290 | 1280 | | |
| 0.9 | 7.91 | 33.9 | 27.2 | 268 | 215 | 268 | 215 | 10.0 | 102 | 1020 | 1020 | 1290 | 1240 | 79.1 | 82.2 |
| 1.8 | 7.63 | 18.5 | 15.6 | 141 | 119 | 150 | 127 | 9.64 | 112 | 1080 | 1120 | 1170 | 1250 | 95.7 | 89.6 |
| 2.7 | 7.35 | 16.3 | 11.2 | 120 | 82.3 | 135 | 94.3 | 9.28 | 119 | 1104 | 1180 | 1220 | 1270 | 96.7 | 92.9 |
| 3.6 | 7.04 | 15.2 | 9.8 | 107 | 69.0 | 127 | 84.5 | 8.88 | | | SAMPLE LOST | | | | |
| RUN 5 | | | | | | | | | | | | | | | |
| 0 | 7.54 | 163 | 162 | 1230 | 1220 | 1230 | 1220 | 10.0 | 0 | 0 | 0 | 1230 | 1220 | | |
| 0.9 | 7.54 | 37.2 | 31.4 | 280 | 237 | 280 | 237 | 10.0 | 89.3 | 893 | 893 | 1170 | 1130 | 76.3 | 79.0 |
| 1.8 | 7.24 | 22.2 | 14.0 | 161 | 101 | 172 | 110 | 9.55 | 105 | 1000 | 1040 | 1210 | 1150 | 86.0 | 90.4 |
| 2.7 | 6.93 | 17.4 | 10.4 | 121 | 72.1 | 139 | 85.9 | 9.07 | 107 | 970 | 1060 | 1200 | 1150 | 88.3 | 92.2 |
| 3.6 | 6.70 | 13.6 | 8.9 | 91 | 59.6 | 113 | 75.8 | 8.74 | 101 | 883 | 1010 | 1120 | 1090 | 90.2 | 92.7 |
| RUN 6 | | | | | | | | | | | | | | | |
| 0 | 7.85 | 163 | 162 | 1280 | 1270 | 1280 | 1270 | 10.0 | 0 | 0 | 0 | 1280 | 1270 | | |
| 0.9 | 7.85 | 31.7 | 23.4 | 249 | 184 | 249 | 184 | 10.0 | 91.8 | 918 | 918 | 1170 | 1100 | 78.5 | 83.5 |
| 1.8 | 7.55 | 22.2 | 11.6 | 168 | 87.6 | 259 | 94.6 | 9.60 | 112 | 1075 | 1100 | 1360 | 1190 | 80.9 | 92.4 |
| 2.7 | 7.24 | 16.1 | 9.9 | 117 | 71.7 | 132 | 82.3 | 9.14 | 114 | 1040 | 1150 | 1280 | 1230 | 89.8 | 93.5 |
| 3.6 | 6.92 | 15.2 | 8.6 | 105 | 59.5 | 126 | 73.3 | 8.77 | 116 | 1020 | 1190 | 1320 | 1260 | 90.2 | 94.4 |

*kg of liquor
ϕAdjustments to take into account withdrawal

EXAMPLE 2

Following the procedure employed in Example 1, new tests were run on ore samples. In the first run, the air flow was 80 liters per minute (±20%). In the second run, the air flow was 100 liters per minute (±20%). The compositions before and after the runs are shown in Table IV.

TABLE IV

| Composition of Barren Leachate Before and After Stripping | | AFTER Run No. 1 | AFTER Run No. 2 |
|---|---|---|---|
| Air Flow (l/min ± 20%) | BEFORE | 80 | 100 |
| pH | 10.4 | 9.7 | 10.2 |
| alkalinity | 575 | 170 | 169 |
| $CN_T$ | 213 | 29.4 | 24.6 |
| $CN_{WAD}$ | 218 | 7.4 | 6.8 |
| hardness | 307 | 2170 | 2030 |
| $SO_4$ | 360 | 2525 | 2350 |
| SCN | 34 | 37 | 38 |
| E.C. (μs/cm 20° C.) | 1710 | | |
| As | 0.8 | 0.8 | 0.7 |
| Ca | 123 | 869 | 814 |
| Cd | <0.01 | <0.01 | <0.01 |

TABLE IV-continued

| | | | |
|---|---|---|---|
| Cr | 0.02 | <0.02 | <0.02 |
| Co | 0.16 | 0.33 | 0.30 |
| Cu | 4.7 | 6.0 | 6.1 |
| Fe | 1.3 | 8.7 | 6.7 |
| Pb | <0.1 | <0.1 | <0.1 |
| Mn | 0.01 | 0.02 | 0.02 |
| Hg | | | |
| Ni | 0.12 | 0.43 | 0.41 |
| Se | | | |
| Ag | 0.15 | 0.04 | 0.04 |
| Zn | 0.64 | 0.01 | 0.06 |
| Reagent consumption to either lower or raise pH for 10 l slurry | | | |
| final pH | 8.1 | 9.7 | 10.0 |
| reagent | 10% v/v $H_2SO_4$ | $Ca(OH)_2$ | $Ca(OH)_2$ |
| amount | 110 ml | 7.7 g | 9.0 g |

The pH of the initial slurry was 8.1. This pH was achieved by adding 110 milliliters of 10 volume percent $H_2SO_4$ to the 10 liters of slurry. After run number 1, 7.7 grams of $Ca(OH)_2$ was added to the tails to raise the pH to 9.7. After run number 2, 9.0 grams of $Ca(OH)_2$ was added to the tails to raise the pH to 10.0. The results for runs number 1 and 2 in Example 2 are shown in Table V.

TABLE V

| Analyses and Balances of Cyanide | | | | | | | |
|---|---|---|---|---|---|---|---|
| HOURS STRIPPING | SLURRY kg.* in system | ppm CN T | ppm CN WAD | mg CN T | mg CN WAD | ADJ. ϕmg CN T | ADJ. ϕmg CN WAD |
| RUN 1 | | | | | | | |
| 0 | 7.94 | 213 | 218 | 1690 | 1730 | 1690 | 1730 |
| 1 | 7.94 | 41.7 | 16.7 | 331 | 133 | 331 | 133 |
| 2 | 7.66 | 36.3 | 11.3 | 278 | 86.6 | 290 | 91.3 |
| 3 | 7.36 | 33.0 | 10.0 | 243 | 73.6 | 265 | 81.6 |
| 4 | 7.05 | 25.5 | 6.0 | 180 | 42.3 | 213 | 53.5 |
| RUN 2 | | | | | | | |
| 0 | 8.02 | 213 | 218 | 1710 | 1750 | 1710 | 1750 |
| 1 | 8.02 | 37.2 | 17.2 | 298 | 138 | 298 | 138 |

TABLE V-continued

| Analyses and Balances of Cyanide | | | | | | | |
|---|---|---|---|---|---|---|---|
| 2 | 7.72 | 26.0 | 8.2 | 201 | 63.3 | 212 | 68.4 |
| 3 | 7.46 | 25.5 | 10.2 | 190 | 76.1 | 208 | 83.3 |
| 4 | 7.14 | 23.5 | 12.4 | 168 | 88.5 | 194 | 99.1 |

| HOURS STRIPPING | NaOH kg. in system | NaOH ppm CN | NaOH mg CN | NaOH ADJ. mg CN | Total CN T | Total CN WAD | % Extn T | % Extn WAD |
|---|---|---|---|---|---|---|---|---|
| RUN 1 | | | | | | | | |
| 0 | 10.0 | 0 | 0 | 0 | 1690 | 1730 | | |
| 1 | 10.0 | 95.4 | 954 | 954 | 1290 | 1090 | 74.0 | 87.5 |
| 2 | 9.69 | 95.8 | 928 | 957 | 1250 | 1080 | 76.6 | 88.6 |
| 3 | 9.32 | 100 | 932 | 997 | 1260 | 1080 | 79.1 | 92.3 |
| 4 | 8.94 | 98.7 | 882 | 985 | 1200 | 1040 | 82.1 | 94.7 |
| RUN 2 | | | | | | | | |
| 0 | 10.0 | 0 | 0 | 0 | 1710 | 1750 | | |
| 1 | 10.0 | 122 | 1220 | 1220 | 1520 | 1360 | 80.0 | 89.7 |
| 2 | 9.63 | 138 | 1330 | 1380 | 1590 | 1450 | 86.8 | 95.2 |
| 3 | 9.28 | 133 | 1230 | 1320 | 1530 | 1400 | 86.3 | 94.3 |
| 4 | 8.95 | 138 | 1240 | 1380 | 1570 | 1480 | 87.9 | 93.2 |

*kg of liquor
♦adjustments to take into account withdrawals

EXAMPLE 3

Five runs were performed in order to test the efficiency of a reactor employing air inlets and a turbine to create turbulence. The pH in each run was varied as was the air flow rate. In run number 1, the pH was 8 and the air flow was 290 liters per minute (2.9 meters$^3$/meters$^2$×minute). In run number 2, the pH was 7.8 and the air flow rate was 100 liters per minute (1.0 meters$^3$/meters$^2$×minute). In run number 3, the pH was 8.2 and the air flow rate was 50 liters per minute (0.5 meters$^3$/meters$^2$×minute). In run number 4, the pH was 7.8 and the air flow rate was 200 liters per minute (2.0 meters$^3$/meters$^2$×minute) In run number 5, the pH was 8 and the air flow rate was 200 liters per minute. In runs 1 through 5, 30 liters of solution were tested. Table VI shows the percent $CN_{WAD}$ remaining after 15, 30, 60, 120 and 180 minutes.

TABLE VI

| Time (minutes) | Run 1 | Run 2 | Run 3 | Run 4 | Run 5 |
|---|---|---|---|---|---|
| | Percent $CN_{WAD}$ Remaining | | | | |
| 15 | 59.6 | 76.6 | 96.8 | 52.1 | 66.2 |
| 30 | 36.5 | 58.5 | 92.5 | 33.3 | 42.1 |
| 60 | 27.4 | 46.3 | 46.2 | 20.8 | 24.8 |
| 120 | 22.1 | 30.3 | 35.5 | 12.5 | 21.1 |
| 180 | 19.2 | 23.4 | 33.3 | | 13.5 |

EXAMPLE 4

The efficiency of a flotation machine and a diffuser column were tested in runs 1 and 2 of Example 4, respectively. In run number 1, a flotation machine was employed with a 40 liter per minute air flow into a 3 liter slurry (1.4 meters$^3$/meters$^2$×minute). In run number 2, a diffuser column was employed with 50 liters per minute air introduced into a 10 liter slurry (9.4 meters$^3$/meters$^2$×minute). In both runs 1 and 2, the pH was 8. The results of these tests are shown in Table VII.

TABLE VII

| Time (minutes) | Run 1 | Run 2 |
|---|---|---|
| | Percent $CN_{WAD}$ Remaining | |
| 15 | 43 | 76 |
| 30 | 20 | 60 |

TABLE VII-continued

| Time (minutes) | Run 1 | Run 2 |
|---|---|---|
| | Percent $CN_{WAD}$ Remaining | |
| 60 | 11 | 46 |
| 120 | 10 | 12 |
| 180 | 8 | 7 |

EXAMPLE 5

A continuous pilot plant was used in which five (5) stirred vessels sealed to the atmosphere and each having a volume of 200 liters were connected in series with pipes in and out the top of each vessel. The lead reactor was connected to a vessel through which tailings slurry could be introduced. The lead reactor was also connected to a vessel from which a 10% solution of sulfuric acid could be added. Arrangement was also made to introduce sodium cyanide as required into the lead reactor in order to maintain a desired level of free cyanide in the slurry being leached. The final reactor in the series was connected to a sealed aeration basin having a coarse bubble flexicap defuser in the bottom region of the basin. The aeration basin was divided with plywood baffles into five sections. Each plywood baffle had a hole in the top with a drop pipe to the bottom of the next section with the pipe sized to the flow of feed into the basin. Agitation was accomplished by air flow. The diffuser was connected to a source of compressed air with a controller which could provide a range of controlled air flow rates. A transfer line was connected from the top of the sealed aeration basin to a fan which was capable of providing a negative pressure in the aeration basin and conducting the air and hydrogen cyanide mixture from the vapor space above the liquid in the aeration basin. The exit of the fan was connected to a dilution stack which diluted the effluent hydrogen cyanide with air to allow venting. Another transfer was connected to the lower portion of the aeration basin to allow removal of tailing slurry and transfer to a stirred sealed neutralization vessel. A transfer line into the vessel was used to introduce sodium hydroxide solution to increase the pH to the desired level or a batch basis as necessary. A transfer line allowed removal of the reneutralized tailings slurry. Results from runs using this procedure are presented in Table VIII and Table IX.

TABLE VIII

| Run No. | Slurry Feed Rate ($m^3$/hr) | Influent (pH) | Influent WAD $CN^-$ (mg/L) | Air Flow $m^3/m^2 \cdot min$ | Slurry Depth (m) | No. of Reactors In Series | Total Aeration Period (min) | Effluent WAD $CN^-$ (mg/L) |
|---|---|---|---|---|---|---|---|---|
| 1 | 1.7 | 9.6 | 230 | 4.5 | 1.3 | 1 | 138 | 67 |
| 2 | 1.7 | 9.6 | 150 | 4.5 | 1.3 | 1 | 138 | 43 |
| 3 | 2.2 | 9.6 | 228 | 4.6 | 1.3 | 1 | 106 | 67 |
| 4 | 2.2 | 9.7 | 228 | 3.9 | 1.3 | 1 | 106 | 67 |
| 5 | 1.7 | 9.7 | 198 | 4.4 | 1.3 | 3 | 138 | 60 |
| 6 | 1.8 | 9.7 | 195 | 4.5 | 1.3 | 3 | 130 | 52 |
| 7 | 2.2 | 9.8 | 168 | 2.4 | 1.3 | 3 | 106 | 84 |
| 8 | 2.2 | 10.0 | 182 | 4.5 | 1.3 | 5 | 92 | 61 |
| 9 | 0.5 | 10.0 | 207 | 4.5 | 1.3 | 5 | 312 | 26 |
| 10 | 0.5 | 10.0 | 157 | 2.8 | 1.3 | 5 | 312 | 28 |
| 11 | 0.5 | 10.0 | 198 | 4.5 | 1.3 | 5 | 312 | 23 |
| 12 | 0.5 | 10.0 | 170 | 4.5 | 1.3 | 5 | 312 | 22 |
| 13 | 0.5 | 10.0 | 203 | 4.5 | 1.3 | 5 | 312 | 23 |
| 14 | 0.5 | 10.0 | 179 | 6.2 | 1.3 | 5 | 312 | 16 |
| 15 | 0.5 | 10.0 | 171 | 8.8 | 1.3 | 3 | 187 | 16 |
| 16 | 0.5 | 9.9 | 161 | 4.5 | 1.3 | 5 | 312 | 19 |
| 17 | 0.5 | 9.0 | 176 | 6.0 | 1.3 | 5 | 312 | 15 |

TABLE IX

| Influent $CN^-$ | pH | Air Flux $m^3/m^2 \cdot min$ | Complete Mix Reactor Stage | Aeration Period (min) | Effluent $CN^-$ |
|---|---|---|---|---|---|
| 198 | 6.0 | 4.5 | 1 | 63 | 33 |
| | | | 2 | 125 | 31 |
| | | | 3 | 187 | 27 |
| | | | 4 | 250 | 25 |
| | | | 5 | 312 | 24 |
| 179 | 8.0 | 6.2 | 1 | 63 | 21 |
| | | | 2 | 125 | 20 |
| | | | 3 | 187 | 17 |
| | | | 4 | 249 | 18 |
| | | | 5 | 312 | 14 |
| 171 | 8.0 | 8.8 | 1 | 63 | 16 |
| | | | 2 | 125 | 15 |
| | | | 3 | 187 | 16 |

EXAMPLE 6

A continuous pilot plant was used as in Example 5 except the agitator was removed from the final pH adjustor reactor in the series and aeration basin was replaced by a packed tower having a diameter of 0.5 meters and a height of 6 meters. The tower was packed with about 3 meters of either 50 millimeter or 75 millimeter plastic Pall rings. The influent distribution system consisted of a ceramic multiple weir trough and a demister. The packing media was supported by a multiple-beam ceramic gas injector plate. The results from this configuration are provided in Table X for 75 mm rings and Table XI for 50 mm rings.

TABLE X

| Run No. | Slurry Flow ($m^3$/hr) | Air Flow ($m^3$/hr) | No. of Tower Passes | Air/ Liquid Ratio | Influent WAD $CN^-$ | Effluent WAD $CN^-$ | pH of Slurry |
|---|---|---|---|---|---|---|---|
| 1 | 2.37 | 845 | 1 | 357 | 182 | 36.6 | — |
| 2 | 2.37 | 845 | 1 | 357 | 182 | 24.5 | — |
| 3 | 1.94 | 839 | 1 | 432 | 156 | 45.1 | — |
| 4 | 2.17 | 839 | 1 | 387 | 166.4 | 22.7 | — |
| 5 | 2.54 | 839 | 1 | 330 | 166.4 | 22.7 | — |
| 6 | 2.10 | 2126 | 1 | 1012 | 192.4 | 15.0 | 7.9 |
| 7 | 2.21 | 2126 | 1 | 962 | 192.4 | 13.7 | — |
| 8 | 2.33 | 1484 | 1 | 637 | 197.6 | 18.3 | 8.0 |
| | 2.39 | 1400 | 2 | 586 | 19.1 | 5.6 | — |
| 9 | 2.36 | 1615 | 1 | 684 | 223.6 | 23.9 | 7.9 |
| | 2.45 | 1615 | 2 | 659 | 22.0 | 6.0 | 8.1 |
| 10 | 4.1 | 2137 | 1 | 571 | 174.0 | 29.0 | 7.6 |
| | 4.0 | 2137 | 2 | 534 | 25.0 | 7.0 | — |
| 11 | 4.17 | 2581 | 1 | 619 | 193.0 | 26.0 | 7.7 |
| | 4.0 | 2581 | 2 | 645 | 22.0 | 7.0 | — |

TABLE XI

| Run No. | Slurry Flow ($m^3$/hr) | Air Flow ($m^3$/hr) | No. of Tower Passes | Air/ Liquid Ratio | Influent WAD $CN^-$ | Effluent WAD $CN^-$ | pH of Slurry |
|---|---|---|---|---|---|---|---|
| 12 | 3.9 | 1364 | 1 | 349 | 165.0 | 23.0 | 7.8 |
| | 3.7 | 1364 | 2 | 369 | | | |
| 13 | 5.0 | 1682 | 1 | 336 | 186.0 | 25.0 | 7.7 |
| | 4.6 | 1682 | 2 | 365 | | | |
| 14 | 4.0 | 2452 | 1 | 613 | 213.2 | 17.5 | 7.5 |
| | 4.1 | 2452 | 2 | 598 | | | |

TABLE XI-continued

| Run No. | Slurry Flow ($m^3$/hr) | Air Flow ($m^3$/hr) | No. of Tower Passes | Air/ Liquid Ratio | Influent WAD $CN^-$ | Effluent WAD $CN^-$ | pH of Slurry |
|---|---|---|---|---|---|---|---|
| 15 | 4.1 | 1403 | 1 | 342 | 202.8 | 22.9 | 7.6 |
| | 3.9 | 1403 | 2 | 360 | | | |
| 16 | 4.18 | 2389 | 1 | — | 170.8 | 14.4 | 7.9 |
| 17 | 4.2 | 2389 | 1 | — | 162.9 | 14.1 | — |

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A process for regenerating cyanide from a cyanide-containing slurry comprising:

(a) adjusting the pH of the cyanide-containing slurry to between about 6 and about 9.5, (b) volatilizing HCN in the pH adjusted slurry from step (a), and (c) contacting the volatilized HCN with a basic material.

2. The process of claim 1 wherein the pH of the cyanide-containing slurry is adjusted to between about 7 to about 9.

3. The process of claim 1 wherein the pH of the cyanide-containing slurry is adjusted to about 8.

4. The process of claim 1 wherein said cyanide-containing slurry has a pH of at least about 10 before said pH adjusting and said pH adjusting is accomplished using an acid.

5. The process of claim 4 wherein said acid is $H_2SO_4$.

6. The process of claim 1 wherein the volatilizing of HCN in the pH adjusted slurry is accomplished by introducing air into the pH adjusted slurry or by introducing the pH adjusted slurry into air.

7. The process of claim 1 wherein said basic material is an aqueous solution and said contacting of the volatilized HCN and basic material is accomplished by conducting said HCN and said aqueous solution in a countercurrent flow.

8. The process of claim 7 wherein said basic material is NaOH and said contacting forms NaCN.

9. The process of claim 7 wherein said basic material comprises lime.

10. The process of claim 1 wherein said slurry comprises a tailings slurry resulting from a mineral recovery process employing a cyanide leach.

11. The process of claim 10 wherein said leach is a carbon-in-pulp leach.

12. The process of claim 10 wherein said leach is a carbon-in-leach.

13. The process of claim 1 wherein said slurry is separated from said volatilized HCN and said separated slurry is contacted with a basic material to provide a neutralized slurry.

14. The process of claim 13 wherein liquid and solids are separated from said neutralized slurry and said liquid is treated to remove additional cyanide and said solids are impounded.

15. The process of claim 13 wherein the pH of said neutralized slurry is about 9.5 to about 11.0.

16. The process of claim 8 wherein said NaCN is recycled to provide at least a portion of the cyanide in said cyanide-containing solution.

17. The process of claim 13 further comprising the step of coagulating metal complexes in the neutralized slurry.

18. The process of claim 17 wherein said coagulation is accomplished by adding $FeCl_3$, an organic sulfide or mixtures thereof.

19. The process of claim 14 wherein said additional cyanide is removed by oxidation.

20. The process of claim 19 wherein $H_2O_2$is employed to oxidize said additional cyanide.

21. The process of claim 1, wherein said volatilizing step comprises contacting the pH adjusted slurry with a volatilizing gas in a packed tower.

22. The process of claim 1, wherein said slurry comprises between about 25 and about 60 weight percent solids.

23. A process for regenerating cyanide from an alkaline cyanide-containing slurry while minimizing equipment fouling said method comprising:

(a) adjusting the pH of the cyanide-containing slurry to between about 7 and about 9.5 to provide a pH adjusted slurry;

(b) passing a gas through said pH adjusted slurry to remove HCN from said adjusted slurry and form an HCN-gas mixture; and (c) contacting said HCN-gas mixture with a basic solution to form a cyanide salt.

24. The process of claim 23, wherein said passing step occurs in a packed tower.

25. The process of claim 23, wherein said slurry comprises between about 25 and about 60 weight percent solids.

26. A method for recovering metal values from an ore said method comprising:

(a) leaching said ore with a cyanide-containing solution at a pH of at least about 10.0 to provide a cyanide-containing slurry with dissolved metal values;

(b) contacting said cyanide-containing slurry with activated carbon to load said carbon with said dissolved metal values;

(c) separating said loaded carbon from said slurry to provide a barren slurry;

(d) adjusting the pH of said barren slurry from above about 10 to between about 6 and about 9.5 to provide a pH adjusted slurry;

(e) passing a volatilization gas through said pH adjusted slurry to form a HCN-gas mixture;

(f) removing said HCN-gas mixture from said pH adjusted slurry and contacting said mixture with a basic solution to form a solution containing cyanide; and (g) returning said cyanide solution to said ore leaching.

27. The method of claim 26 wherein said ore is simultaneously contacted with said cyanide-containing solution and said activated carbon.

28. The method of claim 26 wherein said ore is leached with said cyanide before contacting with said activated carbon.

29. The method of claim 26 wherein said pH adjusted slurry and said volatilization gas are contacted in countercurrent flow in a high void ratio media having a void ratio of greater than about 50 percent.

30. The method of claim 26, wherein said passing step occurs in a packed tower.

31. The method of claim 26, wherein said slurry comprises between about 25 and about 60 weight percent solids.

32. A process for regenerating cyanide from a tailings slurry resulting from a mineral recovery process employing cyanide leach solution, comprising the steps of:

(a) adjusting the tailings slurry to have a pH between about pH 6 and about pH 9.5;

(b) passing the slurry through a packed tower counter-current to the flow of a volatilization gas to volatilize HCN;

(c) contacting the volatilized HCN with a basic material; and (d) recovering the basic cyanide solution.

33. A process as claimed in claim 32, wherein the packed tower has a void ratio greater than about 50 percent.

34. A process as claimed in claim 32, wherein said slurry comprises carbon-in-pulp tails.

35. A process as claimed in claim 32, wherein said slurry comprises carbon-in-leach tails.

36. A process as claimed in claim 32, wherein said slurry contains between about 25 and about 60 weight percent solids.

37. A process as recited in claim 32, wherein the packed tower comprises packing media selected from the group consisting of fiberglass, mild steel, stainless steel and concrete.

* * * * *